US012239236B2

(12) United States Patent
Preutz

(10) Patent No.: US 12,239,236 B2
(45) Date of Patent: Mar. 4, 2025

(54) FOLDING CHAIR COMPRISING A SEAT UPHOLSTERY ARRANGED TO BE FLAT IN A FOLDED STATE

(71) Applicant: Inter IKEA Systems B.V., Ln Delft (NL)

(72) Inventor: Henrik Preutz, Almhult (SE)

(73) Assignee: Inter IKEA Systems B.V., Ln Delft (NL)

( * ) Notice: Subject to any disclaimer, the term of this patent is extended or adjusted under 35 U.S.C. 154(b) by 155 days.

(21) Appl. No.: 18/035,909

(22) PCT Filed: Nov. 8, 2021

(86) PCT No.: PCT/SE2021/051112

§ 371 (c)(1),
(2) Date: May 8, 2023

(87) PCT Pub. No.: WO2022/098292

PCT Pub. Date: May 12, 2022

(65) Prior Publication Data

US 2023/0404265 A1 Dec. 21, 2023

(30) Foreign Application Priority Data

Nov. 9, 2020 (SE) ..... 2051300-8

(51) Int. Cl.
*A47C 4/28* (2006.01)
*A47C 4/04* (2006.01)
(Continued)

(52) U.S. Cl.
CPC ..... *A47C 4/28* (2013.01); *A47C 4/04* (2013.01); *A47C 4/08* (2013.01); *A47C 4/18* (2013.01)

(58) Field of Classification Search
CPC .... A47C 4/28; A47C 4/04; A47C 4/08; A47C 4/18; A47C 4/10; A47C 7/24; A47C 4/028; A47C 9/10
(Continued)

(56) References Cited

U.S. PATENT DOCUMENTS 3,677,601 A * 7/1972 Morrison ..... A47C 7/18 297/452.17
6,871,861 B2 * 3/2005 Hernandez, Jr. ..... B25H 5/00 280/32.6
(Continued)

FOREIGN PATENT DOCUMENTS

DE 33 25 142 A 1/1985
GB 2098471 A 11/1982
JP 2013154043 A * 8/2013

OTHER PUBLICATIONS

PCT International Search Report for PCT Application No. PCT/SE2021/051112 mailed Jul. 12, 2021 (4 pages).
PCT Written Opinion for PCT Application No. PCT/SE2021/051112 mailed Dec. 11, 2021 (4 pages).

*Primary Examiner* — Robert Canfield
(74) *Attorney, Agent, or Firm* — Merchant & Gould P.C.

(57) ABSTRACT

A folding chair is provided, comprising a first front leg (10*a*) and a second front leg (10*b*), said front legs (10*a*, 10*b*) extending substantially parallel to each other, a first rear leg (20*a*) being connected to the first front leg (10*a*) in a pivoting manner, and a second rear leg (20*b*) being connected to the second front leg (10*b*) in a pivoting manner, said rear legs (20*a*, 20*b*) extending substantially parallel to each other. A rear cross beam (22) is extending between the rear legs (20*a*, 20*b*) and defining a cross direction (DC) being substantially perpendicular to the front legs (10*a*, 10*b*) and the rear legs (20*a*, 20*b*), and a seat element (30) is having a central section being connected to the front legs (10*a*, 10*b*) in a pivoting and/or sliding manner and an end
(Continued)

Figure 1:
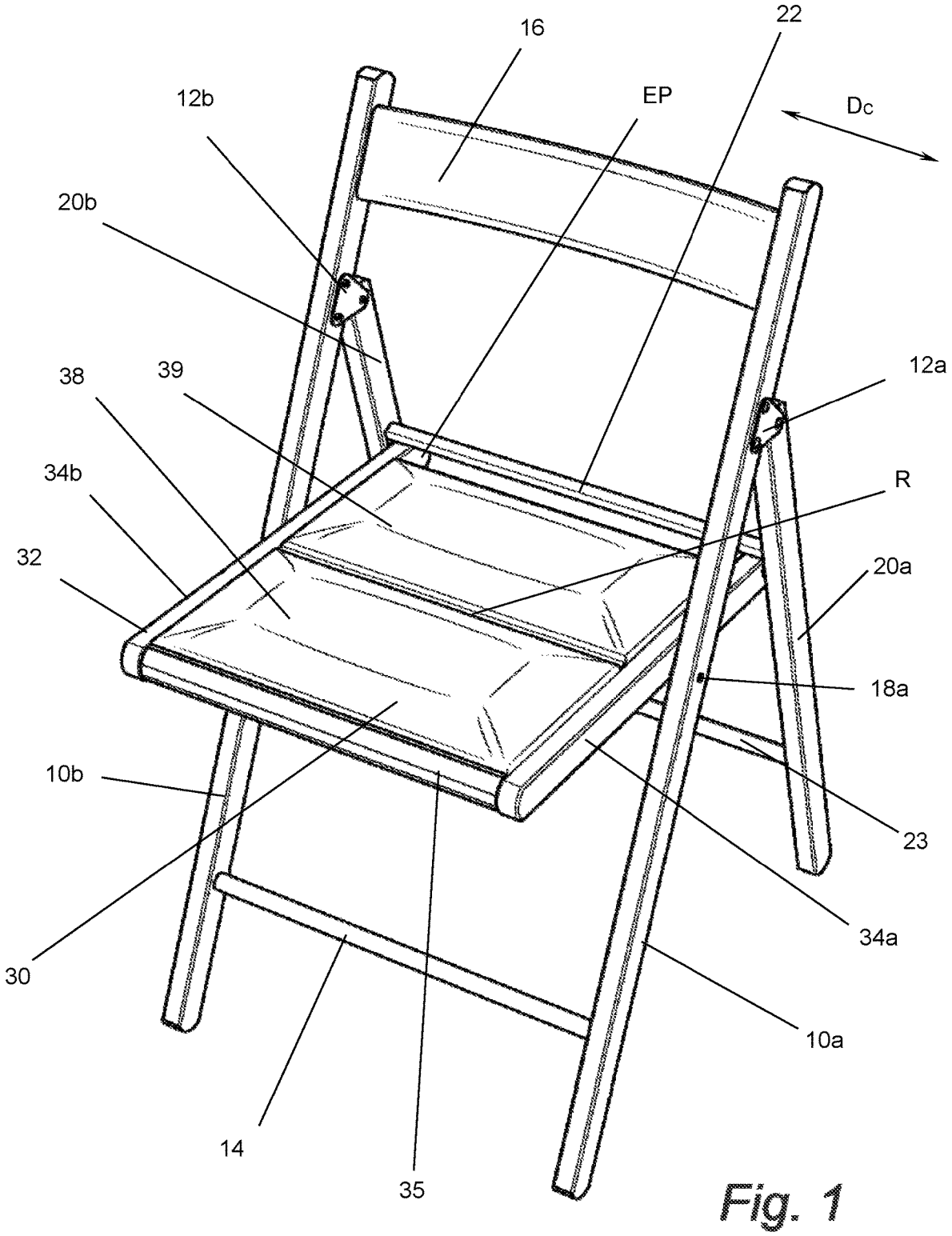

portion (39) being connected to the rear legs (20*a,* 20*b*) in a pivoting and/or sliding manner.

7 Claims, 3 Drawing Sheets

(51) Int. Cl.
*A47C 4/08* (2006.01)
*A47C 4/18* (2006.01)
*A47C 7/24* (2006.01)

(58) Field of Classification Search
USPC ..... 297/16.2, 33, 55, 58
See application file for complete search history.

(56) References Cited

U.S. PATENT DOCUMENTS

| | | | | |
|---|---|---|---|---|
| 6,890,026 | B1 * | 5/2005 | Shin | A47C 4/02 182/35 |
| 6,953,221 | B1 * | 10/2005 | Tseng | A47C 4/10 297/23 |
| 7,226,123 | B1 * | 6/2007 | Lin | A47C 4/24 297/56 |
| 11,779,119 | B1 * | 10/2023 | Goldman | A47C 9/06 297/16.1 |
| 2004/0239153 | A1 | 12/2004 | Leng | |
| 2009/0236879 | A1 | 9/2009 | Akkad | |
| 2011/0298263 | A1 | 12/2011 | Bateman et al. | |
| 2016/0081481 | A1 * | 3/2016 | King | A61G 5/1091 297/250.1 |

* cited by examiner

FOLDING CHAIR COMPRISING A SEAT UPHOLSTERY ARRANGED TO BE FLAT IN A FOLDED STATE

This application is a National Stage Application of PCT/SE2021/051112, filed 8 Nov. 2021, which claims benefit of Serial No. 2051300-8, filed 9 Nov. 2020 in Sweden, and which applications are hereby incorporated by reference in their entireties. To the extent appropriate, a claim of priority is made to each of the above disclosed applications.

The invention relates to a folding chair.

Such folding chairs are well known in the art. They are easy to manufacture, light-weight, easy to use and only need a minimum of storage space.

A folding chair of the generic type comprises a first front leg and a second front leg that extend substantially parallel to each other, a first rear leg being connected to the first front leg in a pivoting manner, and a second rear leg being connected to the second front leg in a pivoting manner. The rear legs also extend substantially parallel to each other. A seat element is held by the front and rear legs in a non-rigid manner. The seat element has a central portion which is connected to the front legs and an end portion which is connected to the rear legs. Most often, the central portion of the seat element is connected to the front legs in a pivoting manner and the end portion of the seat element is connected to the rear legs in a sliding manner, but it is also possible that the central portion of the seat element is connected to the front legs in a sliding manner and the end portion of the seat element is connected to the rear legs in a pivoting manner.

The folding chair has a use state and a storage state. In the use state the seat element extends substantially horizontal when the lower ends of the legs stand on a horizontal ground. In the storage state the folding chair is substantially flat, meaning that the rear legs are folded against the front legs such that all legs extend substantially parallel to one another. The plane of the seat element may be slightly slanted towards the direction in which the legs extend.

Usually a rear cross beam extends between the rear legs and defines a cross direction being substantially perpendicular to the front legs and the rear legs. This rear cross beam serves for stabilization purposes in the first place but can additionally serve as an end stop for and end portion of the seat element when the folding chair is in its use state.

Except screws, bolts, hinges and the like, such a folding chair is usually completely made of wood. This has the drawback that the seating surface of the seat element is hard and thus relatively uncomfortable.

Starting from this, it is the task of the invention to provide a folding chair which can be used and stored as easy as the above described folding chair of the prior art but has an improved seating comfort.

In order to improve the seating comfort, the seat element of the inventive folding chair comprises an upholstery. This upholstery enlarges the overall thickness of the seat element, so if no additional measures were taken, the folding seat could not be folded as flat as a generic folding seat according to the prior art. This would of course be a severe drawback. So, according to the invention, the upholstery comprises a recess extending in the cross direction. This recess is position such that in the storage state at least a part of the rear cross beam is located inside the recess of the upholstery. By this measure, the inventive folding chair can be folded like a traditional folding chair.

The upholstery is usually supported by a frame comprising two lateral parts, a front cross beam and a rear cross beam. This frame usually has an upper surface defining a plane. Since it is of course preferred that a person sitting on the seat element mainly contacts the upholstery, not the frame, it is preferred that at least a portion of the upper surface of the upholstery extends above the plane.

In a preferred embodiment, the upholstery comprises a front cushion and a rear cushion which are divided by the recess. This makes the manufacturing easy and cost effective, especially if the two cushions are identical to one another. It is further preferred that both cushions have a convex seating surface.

In the case that the upholstery comprises two cushions, the frame of the seat element usually needs to comprise a middle cross beam at the location of the recess, wherein the two cushions are supported by the middle cross beam. In order to position the cushions correctly, the middle cross beam can have a T-shaped cross section.

Figure 2:
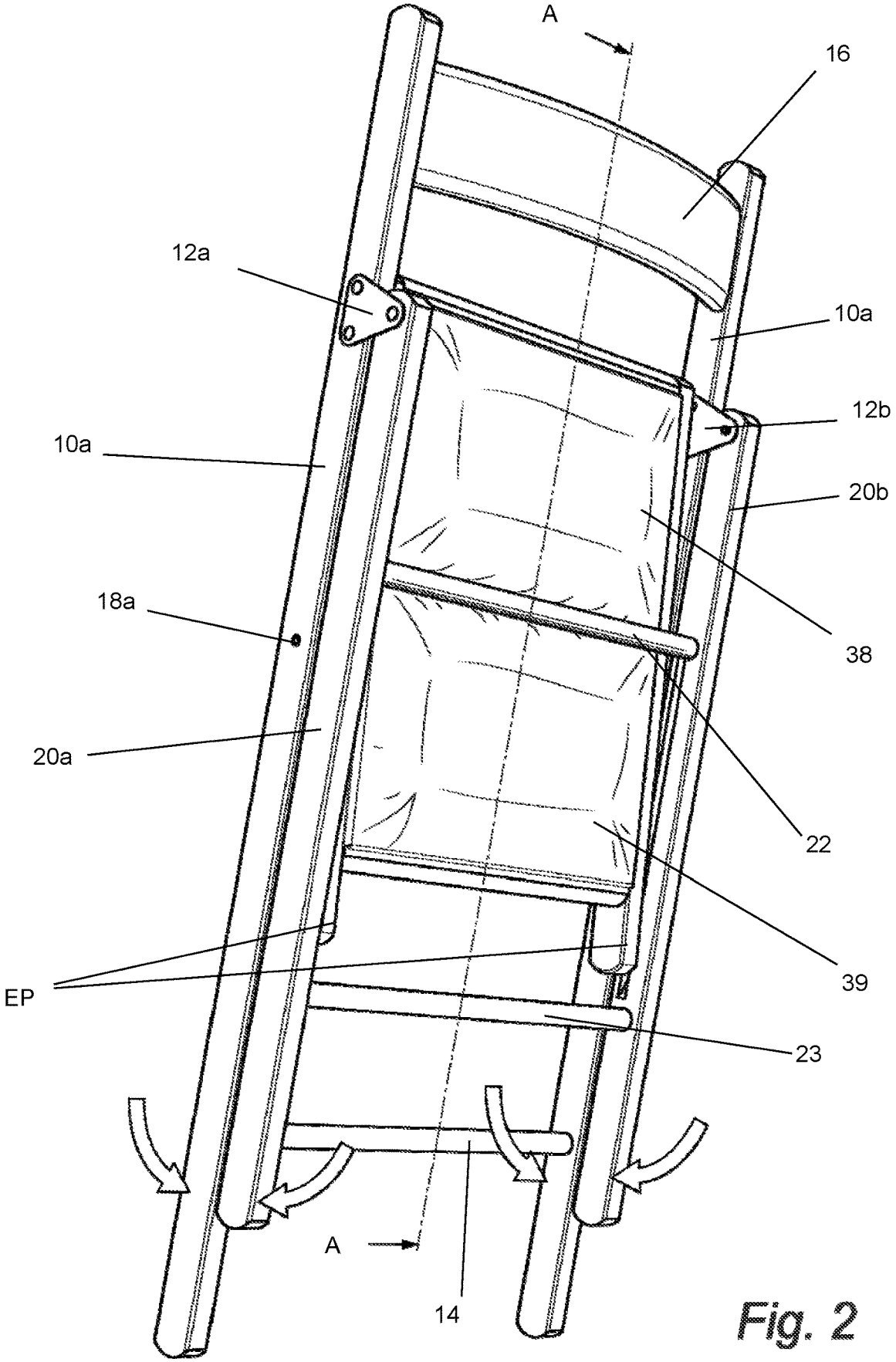
Figure 3:
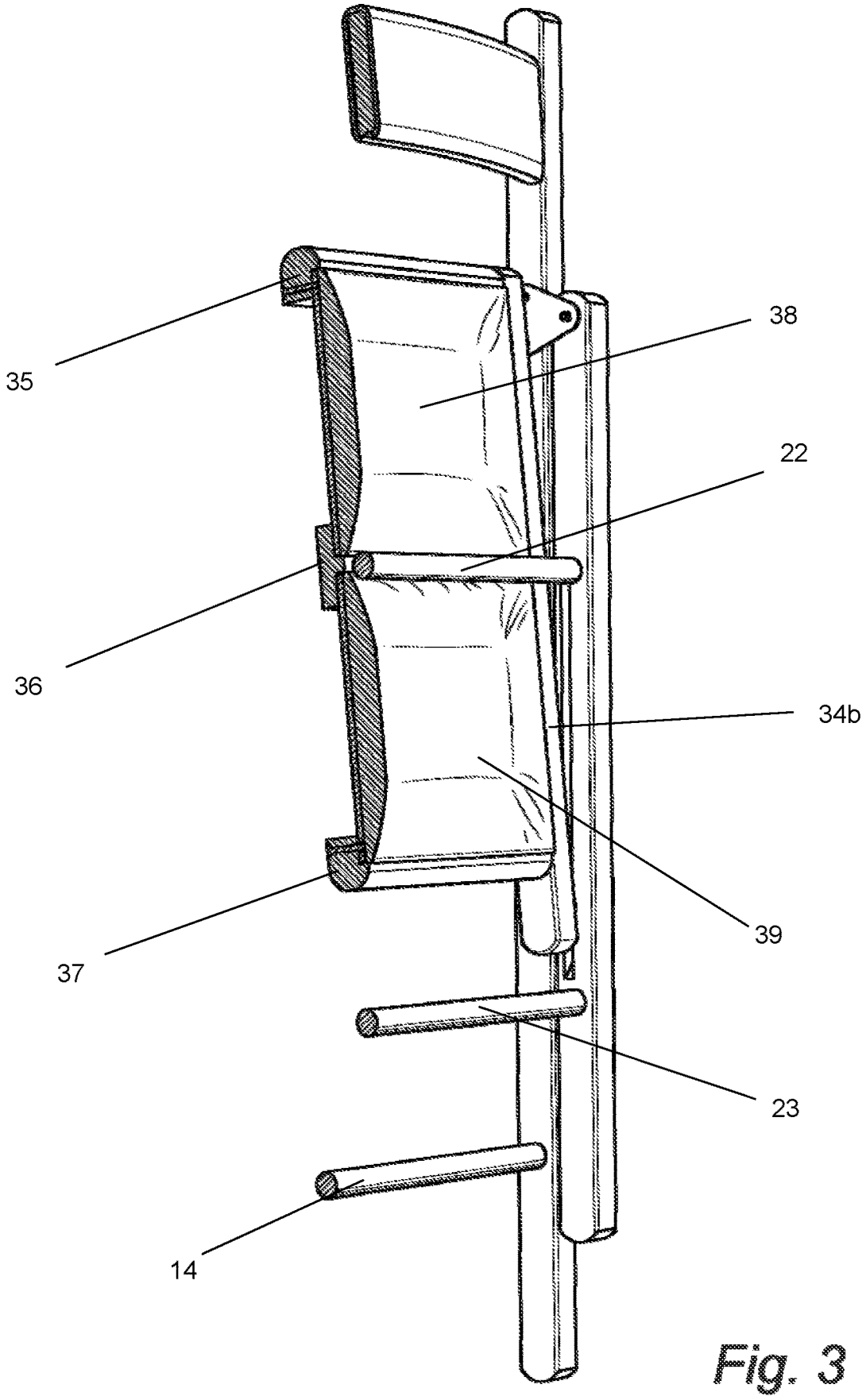

The invention will now be described in detail by means of preferred embodiments in view of the figures. The figures show:

FIG. 1A detailed perspective view of a preferred embodiment of the inventive folding chair being in its use state, FIG. 2 the folding chair of FIG. 1 being in its storage state, and FIG. 3 a sectional view taken along plane A-A in FIG. 2.

The basic construction of the folding chair being shown in FIGS. 1 to 3 is well known. The folding chair comprises a first front leg 10*a* and a second front leg 10*b* extending parallel to the first front leg 10*a*, a first rear leg 20*a* whose upper end is connected to the first front leg 10*a* via a first hinge 12*a* and a second rear leg 20*b* whose upper end is connected to the second front leg 10*b* via a second hinge 12*b*. So, the rear legs 20*a*, 20*b* are connected to the front legs 10*a*, 10*b* in a pivoting manner. The rear legs 20*a*, 20*b* are connected to one another by a rear cross beam 22 and an additional rear cross beam 23. The two rear cross beams 22, 23 extend substantially perpendicular to the rear legs 20*a*, 20*b*. The direction defined by these rear cross beams 22, 23 is referred to as direction $D_c$ of cross beams.

The front legs 10*a*, 10*b* are rigidly connected to one another by means of a backrest 16 and a front cross beam 14.

A seat element 30 is movable connected to the front legs 10*a*, 10*b* and to the rear legs 20*a*, 20*b*. In the embodiment shown, a central section of the seat element 30 is connected to the front legs 10*a*, 10*b* in a pivoting manner. For this reason, for example a bolt can extend from each front leg 10*a*, 10*b* into the seat element 30. One of these two bolts 18*a* is shown in FIGS. 1 and 2. The end portion EP of the seat element 30 is connected to the rear legs 20*a*, 20*b* in a sliding manner. For this reason a groove extends into each rear leg 20*a*, 20*b* (shown in FIGS. 2 and 3) and a bolt extends between each groove and the end portion EP of the seat element (these bolts are not shown in the drawings). This is a very common construction, but it is possible to exchange the pivoting and sliding connection, such that the seat element is in sliding connection to the front legs and in pivoting connection to the rear legs.

The seat element 30 comprises a frame 32 and an upholstery. In the embodiment shown, this upholstery is comprised of two separate cushions, namely a front cushion 38 and a rear cushion 39. The frame 32 consists of two lateral parts 34*a*, 34*b* and three cross beams connecting these two lateral parts 34*a*, 34*b*, namely a first cross beam 35, a middle cross beam 36 and a second cross beam 37. The rear ends of the lateral parts 34*a*, 34*b* form the end portion EP of the frame 32 and thus of the seat element 30. The rear cross beam 22 forms an end stop for this end portion EP when the folding chair is in its use state, as can be seen in FIG. 1.

As can best be seen in FIG. 3 the cushions 38, 39 are attached to or at least supported by the cross beams 35, 36, 37. For this purpose the cross beams have accommodations for end sections of the cushions 38, 39. The middle cross beam 36 of the frame has a T-shaped cross section and the "column" of the T separates the two cushions 38, 39.

Both cushions 38, 39 of course have a seating surface and these seating surfaces extend over the upper surface of the frame 32 at least in sections. This can also best be seen in FIG. 3. Further, the seating surfaces of the cushions are convex meaning that the front cushion 38 has a maximum thickness in a middle portion between the first cross beam 35 and the middle cross beam 36 and the rear cushion 39 has a maximum thickness in a middle portion between the middle cross beam 36 and the second cross beam 37. So, the upholstery being formed of the two cushions 38, 39 has a recess R at the position of the middle cross beam 36 with the surface of the column of the T of the middle cross beam forming the ground of this recess R.

This recess R in the upholstery is positioned such that when the folding chair is in its storage state (FIGS. 2 and 3) the rear cross beam 22 is located inside this recess R at least in sections. In this state the rear cross beam 22 usually contacts the lateral parts 34*a*, 34*b* of the frame. So, despite the fact that the seating surface of the upholstery extends from the surfaces of the frame, the folding chair can be folded like a conventional folding chair without an upholstery, because this upholstery does not interfere with the cross beam 22.

LIST OF REFERENCE NUMBERS

10*a* first front leg
10*b* second front leg
12*a* first hinge
12*b* second hinge
14 front cross beam
16 backrest
18*a* bolt
20*a* first rear leg
20*b* second rear leg
22 rear cross beam
23 additional rear cross beam
30 seat element
32 frame
34*a* first lateral part of frame
34*b* second lateral part of frame
35 first cross beam of frame
36 middle cross beam of frame
37 second cross beam of frame
38 front cushion of upholstery
39 rear cushion of upholstery
$D_c$ direction of cross beams
EP end portion of frame (end portion of seat element)
R recess

The invention claimed is:

1. Folding chair comprising:

a first front leg and a second front leg, said front legs extending substantially parallel to each other, a first rear leg being connected to the first front leg in a pivoting manner, and a second rear leg being connected to the second front leg in a pivoting manner, said rear legs extending substantially parallel to each other, a rear cross beam extending between the rear legs and defining a cross direction being substantially perpendicular to the front legs and the rear legs, a seat element having a central section being connected to the front legs in a pivoting and/or sliding manner and an end portion (EP) being connected to the rear legs in a pivoting and/or sliding manner, wherein the folding chair has a use state and a storage state in which it is substantially flat, characterized in that the seat element comprises an upholstery, wherein said upholstery comprises a recess extending in the cross direction and wherein in the storage state at least a part of the rear cross beam is located inside the recess of the upholstery.

2. Folding chair according to claim 1, wherein the seat element comprises a frame with an upper surface defining a plane, wherein at least a portion of the upper surface of the upholstery extends from this plane.

3. Folding chair according to claim 1, wherein the upholstery comprises a front cushion and a rear cushion being divided by the recess.

4. Folding chair according to claim 3, wherein the frame of the seat element comprises a middle cross beam at the location of the recess, wherein the two cushions are supported by the middle cross beam.

5. Folding chair according to claim 4, wherein the frame of the seat element further comprises a first cross beam and a second cross beam, wherein the front cushion is supported by the first cross beam and the middle cross beam and the rear cushion is supported by the second cross beam and the middle cross beam.

6. Folding chair according to claim 4, wherein the middle cross beam has a T-shaped cross section.

7. Folding chair according to claim 1, wherein the end portion of the seat element abuts the rear cross beam when the folding chair is in its use state.

* * * * *